US005512734A

United States Patent [19]

Copstead

[11] Patent Number: 5,512,734

[45] Date of Patent: Apr. 30, 1996

[54] APPARATUS AND METHOD FOR HEATING USING MICROWAVE ENERGY

[75] Inventor: Terrance R. Copstead, Milton, Fla.

[73] Assignee: Microwave Research Corp., Chicago, Ill.

[21] Appl. No.: 309,054

[22] Filed: Sep. 20, 1994

[51] Int. Cl.[6] ..... H05B 6/80

[52] U.S. Cl. ..... 219/679; 219/687; 219/759; 34/259

[58] Field of Search ..... 219/687, 688, 219/759, 681, 679; 34/259–265

[56] References Cited

U.S. PATENT DOCUMENTS

| | | | |
|---|---|---|---|
| 3,451,401 | 6/1969 | Levinson | 134/58 |
| 3,891,817 | 6/1975 | Brown | 219/687 |
| 4,114,011 | 9/1978 | Stubbs | 219/687 |
| 4,114,012 | 9/1978 | Moen et al. | 219/687 |
| 4,178,494 | 12/1979 | Bottalico et al. | 219/687 |
| 4,334,136 | 6/1982 | Mahan et al. | 219/681 |
| 4,728,762 | 3/1988 | Roth et al. | 219/681 |

FOREIGN PATENT DOCUMENTS

| | | | |
|---|---|---|---|
| 1038458 | 9/1978 | Germany | 219/681 |
| 2928520 | 1/1981 | Germany | 219/688 |
| 3826338 | 2/1990 | Germany | 219/687 |

*Primary Examiner*—Philip H. Leung
*Attorney, Agent, or Firm*—William Brinks; Hofer Gilson & Lione

[57] ABSTRACT

A heating apparatus having features of the present invention comprises a microwave energy source, a reservoir, and a heat exchanger. The reservoir is adapted to contain a flowable medium such as a liquid and is positioned so that the liquid may be heated by the microwave energy source. The heat exchanger is adapted to receive the liquid and is in communication with or coupled to the reservoir. The present invention may further include a pump for circulating the liquid between the reservoir and the heat exchanger. The liquid may be circulated using a conduit. Preferably, the heat exchanger is adapted to use at least some of the liquid heated by the microwave energy source to heat air in proximity to the heat exchanger. Also, a blower positioned near the heat exchanger may be used to direct the air heated by the heat exchanger to a desired space to be heated. The invention is also directed to a method for applying heat to a space comprising the following steps: heating a liquid using microwave energy; passing the heated liquid to a heat exchanger where at least some of the heated liquid is used to heat air; and applying at least some of the heated air to the space.

6 Claims, 3 Drawing Sheets

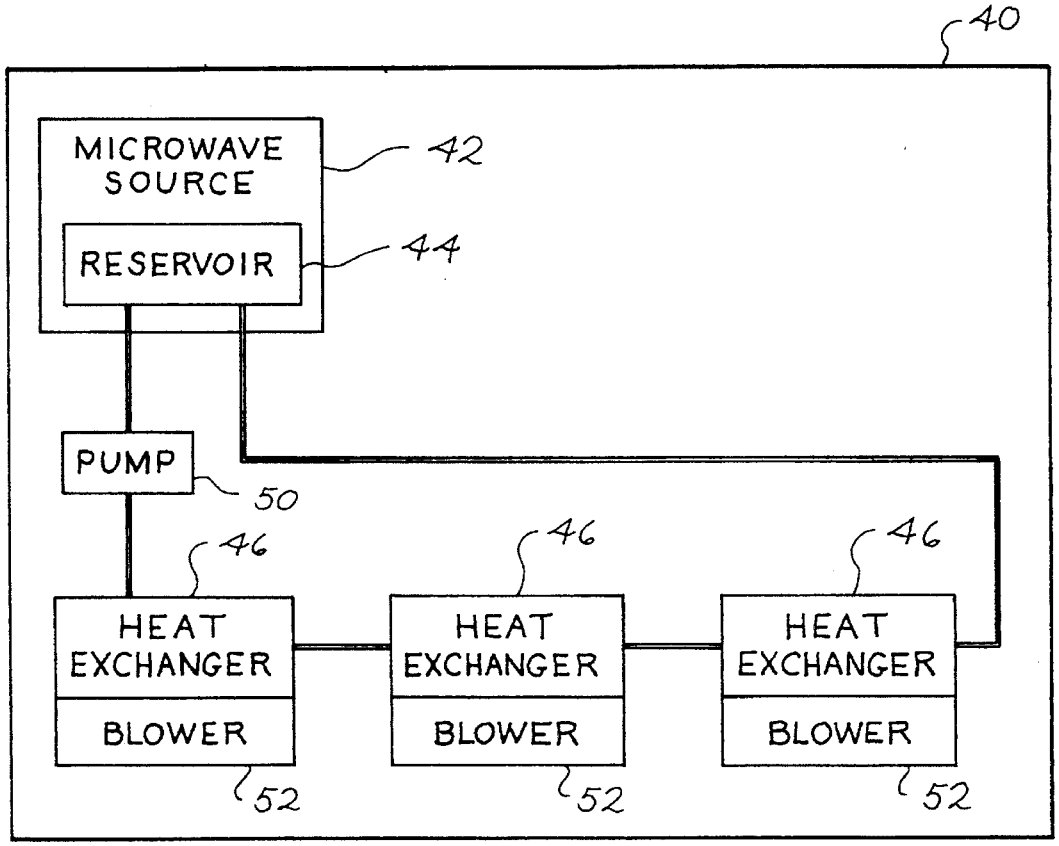
Fig. 3
Fig. 4
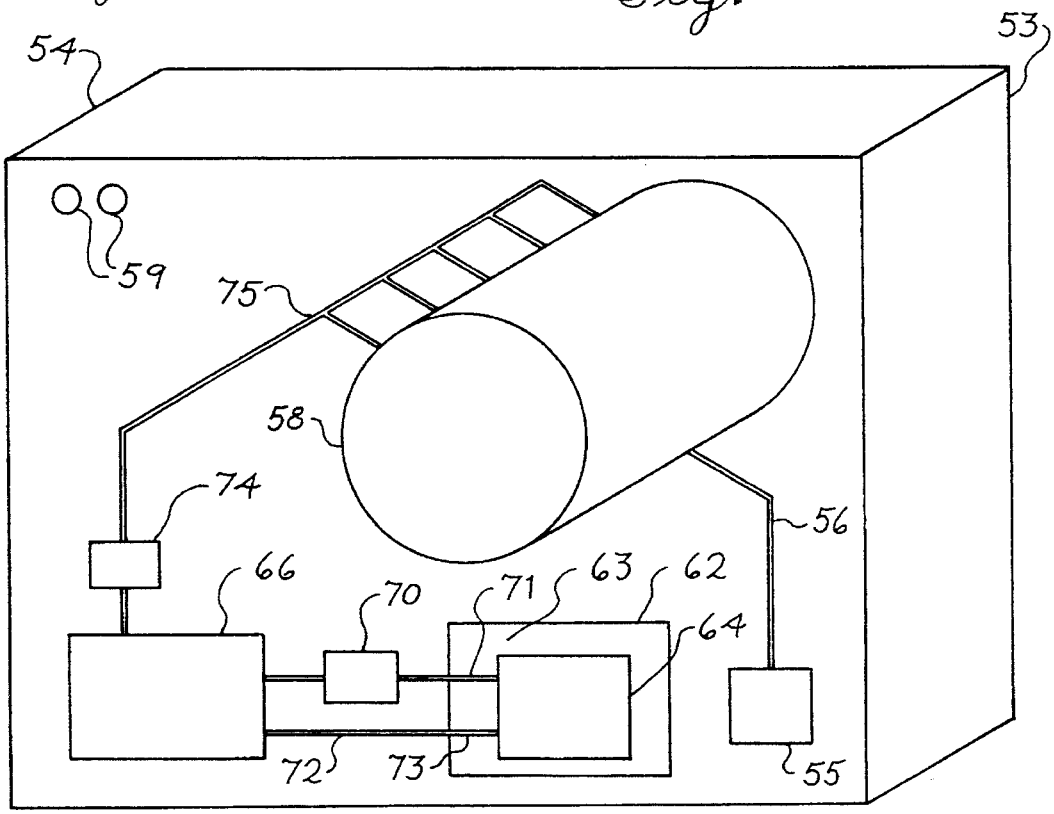

APPARATUS AND METHOD FOR HEATING USING MICROWAVE ENERGY

BACKGROUND OF THE INVENTION

The present invention generally relates to improved heating apparatus and heating methods. More particularly the invention relates to improved apparatus and methods for heating a space by using an efficient source of heat such as microwave energy.

Currently, consumers use relatively large amounts of energy, typically in the form of electricity, heating oil and natural gas, for various and sundry heating applications, in commercial buildings and in residential homes. For example, many residential homes are heated by using so-called forced air furnaces. These furnaces often burn fuel, such as natural gas, supplied from a local utility company. Typically, the natural gas is burned in a gas burner which heats air proximate thereto. The heated air is then directed toward an area to be heated, typically via a blower and duct system. Such a heating system necessarily consumes a substantial amount of energy.

In addition, many residential homes contain appliances, such as a clothes drying machine for drying clothes after they have been washed. Such clothes dryers, if they are of the type that burn natural gas, also use some form of gas burner for heating air, and a duct system for passing the heated air to the chamber in which the clothes to be dried have been placed. In addition to requiring a hook-up to a natural gas supply, clothes dryers of the type described are ordinarily powered from 220 volt sources requiring special electrical wiring. As such, this appliance for drying clothes also consumes a relatively large amount of energy.

Though such heating systems and appliances work satisfactorily, they are nonetheless subject to certain drawbacks and deficiencies. For example, they are often difficult to hook up and connect, and they can consume relatively large amounts of energy, including non-renewable fossil fuels.

It is therefore a primary object of this invention to provide improved apparatus and methods for heating a space. More particularly, it is an object of this invention to provide more energy efficient apparatus and methods for heating a space, be it a commercial building or residential home, or a chamber within an appliance such as a clothes dryer. It is also an object of this invention to provide such apparatus and methods which are more economical than conventional systems and also more efficient to connect and operate.

SUMMARY OF THE INVENTION

The foregoing objects, along with numerous features and advantages, are achieved in an apparatus for heating a space comprising a source of microwave energy, a reservoir, and a heat exchanger. The reservoir is adapted to contain a flowable medium, and is positioned so that the medium may be heated by the source of microwave energy. The heat exchanger, which is in communication with the reservoir, is adapted to receive and use the heated medium to heat air in proximity thereto. The heated air is then applied to the space to be heated.

The present invention may further include a pump for circulating the medium through a conduit interconnecting the reservoir and the heat exchanger. Also, a blower may be used to force the air heated by the medium at the heat exchanger through a duct, toward a desired space to be heated. The blower is preferably positioned near the heat exchanger.

Another aspect of the invention relates to a method for applying heat to a space comprising the steps of heating a flowable medium using microwave energy; passing the heated medium to a heat exchanger where at least some of the heated medium is used to heat air; and applying at least some of the heated air to the space. The microwave energy may be supplied by a microwave source.

In another aspect of the invention, the source of microwave energy, reservoir and heat exchanger form part of a heating appliance such as a clothes dryer. The appliance includes a chamber, in which articles to be heated are disposed. Heated air from the heat exchanger is passed to the chamber, preferably via associated duct work.

An advantage of the present invention is the ability to heat a space, such as a single room in a residence, or a chamber of an appliance, with greatly improved energy efficiency. Also, the present invention advantageously provides for heating larger spaces such as an entire residence or an office building. The present invention provides an apparatus and a method of heating capable of minimizing energy consumption and thereby reducing use of fossil fuels.

Another advantage is that certain embodiments of the present invention, when utilized as a household appliance, may be powered from a standard 110 volt electrical source. For example, in an embodiment where the invention is deployed to heat clothes in a clothes dryer, a user may use a standard 110 volt residential electrical source instead of a special 220 volt electrical source. Moreover, no additional natural gas hook-up is necessary.

BRIEF DESCRIPTION OF THE DRAWINGS

The invention summarized above, along with other features, aspects, and advantages, can be best understood by reading the following description in conjunction with the accompanying drawings, wherein:

FIG. 3 is a block diagram of a heating apparatus of the type shown in FIG. 1, using a plurality of heat exchangers in a serial arrangement;

FIG. 4 is a schematic block diagram of an embodiment of the invention directed to an apparatus for drying clothes;

DETAILED DESCRIPTION OF THE PREFERRED EMBODIMENT

Figure 1:
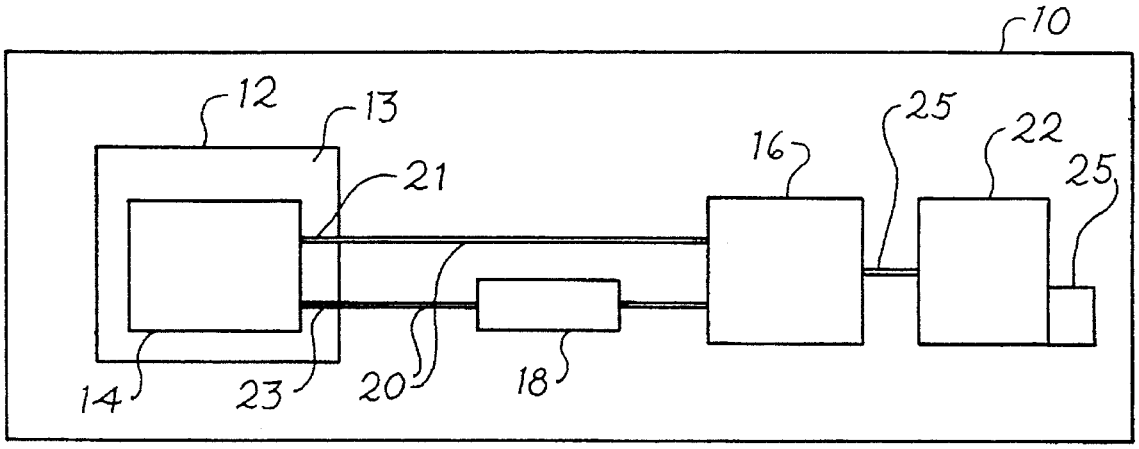
FIG. 1 is a block diagram depicting an embodiment of the present invention.

Referring now to the drawings, FIG. 1 shows a heating apparatus 10 including a source of microwave energy 12, a reservoir 14, and a heat exchanger 16. The microwave energy source 12 is used to generate microwave energy for heating and preferably is powered by a standard 110 volt ac residential electrical supply voltage. The source 12 preferably has a compartment 13 for receiving the microwave energy. The microwave energy source 12 also includes a standard industrial control component (not shown) so that a user may control, for example, the amount of microwave energy from the source 12.

The reservoir 14 is adapted to contain a flowable medium. Though this medium may preferably be a liquid such as water, it need not be so limited as it may also be in the form of a gel or oil. The flowable medium, sometimes referred to hereinafter as a liquid, is disposed in the compartment 13 so that the microwave energy source 12 may heat the liquid. Preferably, the reservoir 14 is a pressurized container capable of minimizing heat loss to the surrounding atmosphere. The reservoir 14 may be made from any suitable material such as glass or plastic, and may be of any suitable dimensions and capacity. If desired, the reservoir 14 may be formed integrally with the source 12, and/or the compartment 13.

The heat exchanger 16 is adapted to receive liquid from the reservoir 14 and is capable of using at least some of the heated liquid to heat at least some of the air surrounding the heat exchanger. The type of heat exchanger is a matter of choice for a person of ordinary skill in the art, depending on variables such as the particular application, size, cost, etc. In a simple form it may be a straight pipe formed of heat conducting material proximate the surrounding air, though a serpentine arrangement is believed to be preferable.

FIG. 1 also shows a pump 18 connected to both the reservoir 14 and the heat exchanger 16 through a conduit 20. The pump 18 circulates liquid between the reservoir 14 and the heat exchanger 16 through the conduit 20. The pump 18 is conventional, and also a matter of choice for a person of ordinary skill in the art.

The conduit 20 preferably directly interconnects the reservoir 14 and the heat exchanger 16. An inlet 21 and an outlet 23 are formed by portions of the conduit 20 connected to the reservoir 14. The inlet 21 is adapted to carry liquid from the heat exchanger 16 outside the compartment 13 to the reservoir 14 within the compartment 13. The outlet 23 is adapted to carry liquid from the reservoir 14 in the compartment 13 toward the heat exchanger 16 outside the compartment 13.

A blower 22, of such size and specifications within the choice of a person of ordinary skill in the art, is preferably positioned sufficiently close to the heat exchanger 16 to force air heated by the heat exchanger 16 through a duct 25 toward a space to be heated by the apparatus 10. The duct 25 is coupled to the heat exchanger 16 and is adapted to direct air heated by the heat exchanger toward the space to be heated.

The apparatus 10 preferably operates in the following manner. The microwave energy source 12 creates microwave energy that heats a flowable medium, typically a liquid such as water, contained in the reservoir 14. The heated liquid is then circulated by the pump 18 through the conduit 20 from the reservoir 14 to the heat exchanger 16. The heat exchanger 16 then uses at least some of the heated liquid to heat at least some of the air proximate the heat exchanger 16. The blower 22, in communication with the duct 25, forces at least some of the heated air near the heat exchanger 16 toward the space to be heated such as a room in a residence.

Since the heat exchanger 16 uses at least some of the heat energy associated with the liquid to heat the air, the liquid emerging from the heat exchanger 16 is cooler than the liquid received by the heat exchanger. The liquid emerging from the heat exchanger 16 is returned by the pump 18 through the conduit 20 to the reservoir 14. Thus, the liquid in the reservoir 14, having been cooled by the transfer of heat at the heat exchanger 16 can again be heated by microwave source 12, whereby the above-described cycle of operation continues as long as a user desires heat to be applied to the space.

Figure 2:
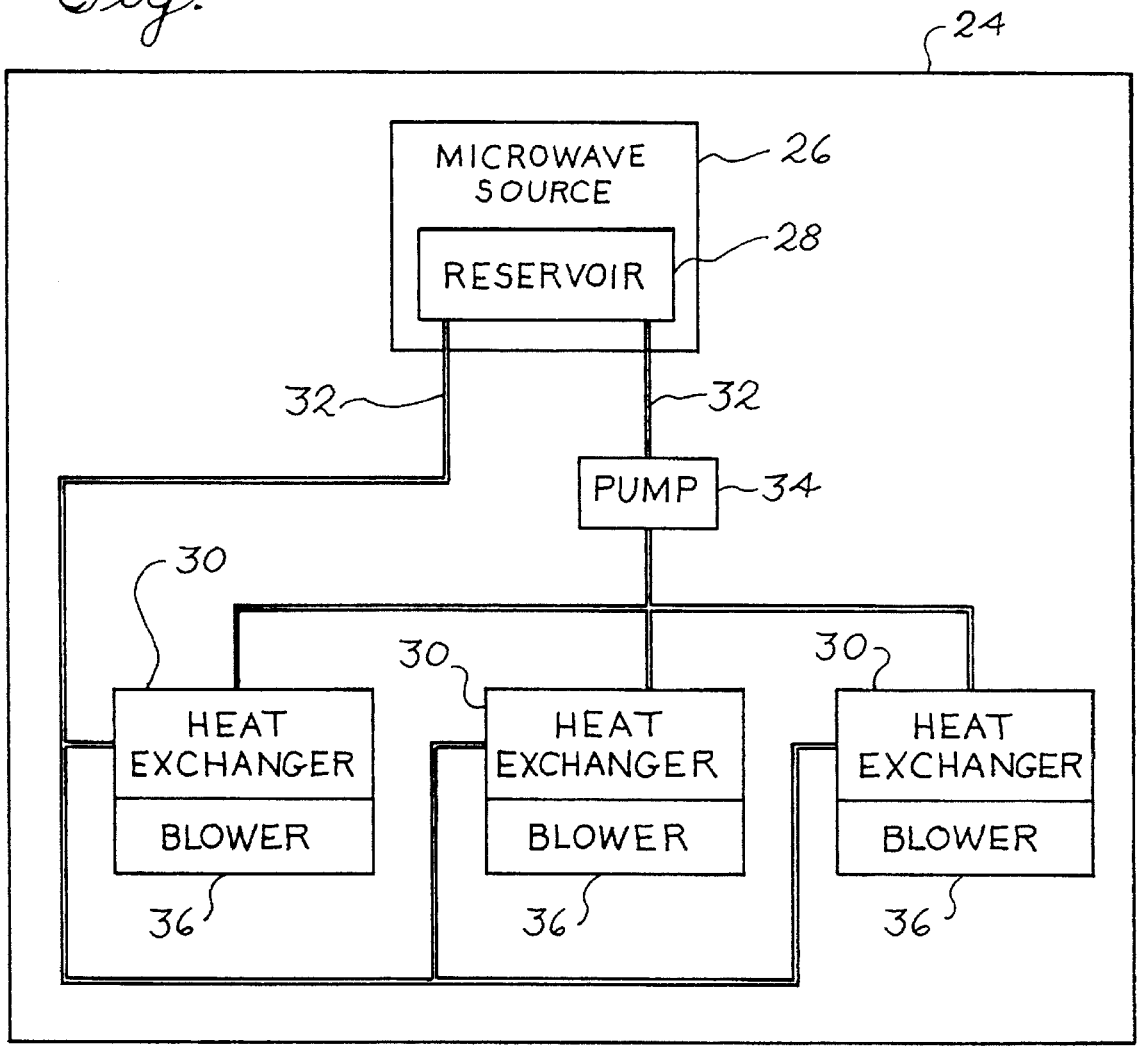
FIG. 2 is a block diagram of a heating apparatus of the type shown in FIG. 1, using a plurality of heat exchangers in a parallel arrangement.

FIG. 2 shows a second embodiment of a heating apparatus 24 including a source of microwave energy 26, a reservoir 28 for containing liquid, and a plurality of heat exchangers 30. The plurality of heat exchangers 30 is connected to the reservoir 28 in a parallel arrangement. Specifically, the reservoir 28 is connected to the plurality of heat exchangers 30 through a conduit 32. A pump 34 is used to circulate liquid from the reservoir 28 to each of the heat exchangers 30. A blower 36 may be positioned near each heat exchanger 30 to direct air heated by each heat exchanger 30 toward the space to be heated. The components used and operation of this embodiment are substantially the same as the apparatus shown in FIG. 1 except that this embodiment includes a plurality of heat exchangers. This embodiment is particularly useful where at least one heat exchanger is placed in each room to be heated.

FIG. 3 shows a further embodiment of a heating apparatus 40 including a source of microwave energy 42, a reservoir for containing liquid 44, and a plurality of heat exchangers 46. In this embodiment, the plurality of heat exchangers 46 is connected to the reservoir 44 in a serial arrangement. The reservoir 44 is connected to each heat exchanger 46 through a conduit 48. A pump 50 circulates liquid from the reservoir 44 through the conduit 48 to each of the heat exchangers 46. A blower 52, positioned near each heat exchanger 46, forces air heated by each heat exchanger toward the space to be heated. The components used and the operation of this embodiment are substantially the same as those used in the apparatus shown in FIG. 1 except that this embodiment includes a plurality of heat exchangers disposed in a serial arrangement. Preferably, at least one heat exchanger is placed in each room to be heated.

FIG. 4 shows an embodiment of the present invention directed toward an appliance 53 for drying clothes specifically using microwave energy. FIG. 4 shows an otherwise conventional clothes drying machine such as Sears Kenmore 60 series model number 110.96560100 using well known components such as a conventional housing 54, a motor 55, a linkage 56, and a tumbler such as a chamber 58 for holding clothes to be dried. The clothes drying machine also includes controls 59 allowing a user to control operation of the motor 55. The housing 54 includes a frame for holding other components of the clothes dryer. The housing has a door (not shown) that can be opened so that a user may put clothes to be dried into the chamber 58. The motor 55, in combination with the mechanical linkage 56, rotates the chamber 58 in a conventional manner that is well known in the art.

The conventional clothes drying machine described above is modified by adding a microwave energy source 62, a reservoir 64 for containing a liquid, and a heat exchanger 66. The microwave energy source 62 is used to generate microwave energy for heating, and preferably powered by a standard 110 volt residential electrical supply voltage. The source 62 has a compartment 63 for receiving the microwave energy. The microwave energy source 62 also includes a standard controller (not shown) so that a user may control the amount of microwave energy. The controller preferably is connected to the controls 59 so that a user may also control operation of the source 62. Such a microwave energy source 62 may be a commercially available microwave oven such as an 850 watt Sears Model MG3090XAQ-O.

The reservoir 64 is adapted to contain a flowable medium, typically a liquid such as water, and is positioned so that the microwave energy source 62 may heat the liquid. Preferably, the reservoir 64 may be a pressurized container to reduce the amount of heat lost from the reservoir 64 to the surrounding atmosphere, such as a 2½ quart Nordicware Tender Cooker Model Number 62104.

The heat exchanger 66 is adapted to receive liquid from the reservoir 64 and is capable of using at least some of the heated liquid to heat at least some of the air surrounding the heat exchanger. Preferably, the heat exchanger 66 is a copper heat exchanger such as Harrison model number 86M. However, a person having skill in the art will appreciate that the heat exchanger 66 may also be injection molded from microwave-safe plastic or high temperature glass.

FIG. 4 shows a pump 70 connected to both the reservoir 64 and the heat exchanger 66 through a conduit 72. The pump 70 circulates liquid between the reservoir 64 and the heat exchanger 66 through the conduit 72. The pump 70 is preferably a self priming Daton pump.

The conduit 72 preferably directly interconnects the reservoir 64 and the heat exchanger 66. The conduit 72 is preferably made from aluminum or copper and has a connecting teflon sleeve over the portion of the conduit 72 in the microwave compartment 63 to avoid microwave arcing. It should be noted that the conduit could be made from other materials such as plastic or high temperature glass. An inlet 71 and an outlet 73 are formed by portions of the conduit 72 connected to the reservoir 64° . The inlet 71 is adapted to carry liquid from the heat exchanger 66 outside the compartment 63 to the reservoir 64 within the compartment 63. The outlet 73 is adapted to carry liquid from the reservoir 64 in the compartment 63 toward the heat exchanger 66 outside the compartment 63.

A blower 74, such as an 86.25 watt Broan model number 688-H/633N cage or squirrel type fan operating at 50 cubic feet per minute, is positioned close to the heat exchanger 66 to force air heated from the liquid at the heat exchanger 66 through a duct 75 toward the chamber 58 containing clothes to be dried. The duct 75 is coupled to the heat exchanger 66 and is adapted to direct air heated by the heat exchanger 66 into the chamber 58.

The appliance for drying clothes 53 operates in the following manner. While the conventional clothes drying machine is operating to rotate the chamber 58 containing clothes, the microwave energy source 62 creates microwave energy that heats a liquid, preferably water, contained in the reservoir 64. The heated liquid is then circulated by the pump 70 through the conduit 72 from the reservoir to the heat exchanger 66. The heat exchanger 66 causes at least some of the heat present in the liquid to heat at least some of the air surrounding the heat exchanger 66. The blower 74 forces this heated air through the duct 75 and into the chamber 58 for holding clothes. Clothes in the rotating chamber 58 are then dried by the application of the heated air.

Since at least some of the heat energy from the liquid is used to heat the air, the liquid emerging from the heat exchanger 66 is cooler than the liquid received by the heat exchanger 66. This cooler liquid from the heat exchanger 66 is therefore circulated by the pump 70 through the conduit 72 back to the reservoir 64, where it can be reheated by the source 62. The above cycle of operation continues until the clothes drying cycle is completed, as preset by controls 59, or is manually stopped.

Although an appliance for drying clothes has been described in great detail, the present invention is not limited to a clothes drying application. For example, certain aspects of the present invention may be used with any other appliance that utilizes heat energy such as a hot water heater or a dishwasher.

Figure 5:
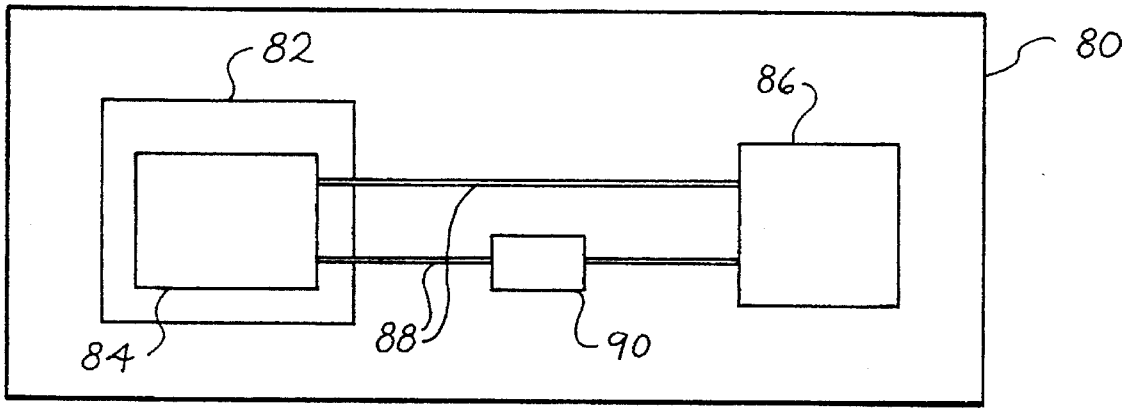
FIG. 5 is a block diagram of an embodiment of the invention directed to a water heating apparatus.

FIG. 5 shows an embodiment of a hot water heater 80 including a source of microwave energy 82, a reservoir 84, and a water tank 86. The reservoir 84 is connected to the water tank 86 through a conduit 88. A pump 90 circulates water heated by the source 82 from the reservoir 84 to the water tank 86, and returns cooled liquid from the water tank 86 to the reservoir 84. The water tank 86 is a conventional water tank that is known in the art, and the other components are substantially similar to corresponding components shown in FIG. 1.

It should be noted that in this embodiment there is no need for a heat exchanger. However, as an alternative embodiment, a coil (not shown) could be substituted for the heat exchanger 16 of FIG. 1 by connecting the coil to the reservoir 84 through the conduit 88. In such an embodiment, the coil is wrapped inside the water tank 86 and is adapted to heat water in the tank 86 when liquid heated by the source 82 is passed through the coil.

Figure 6:
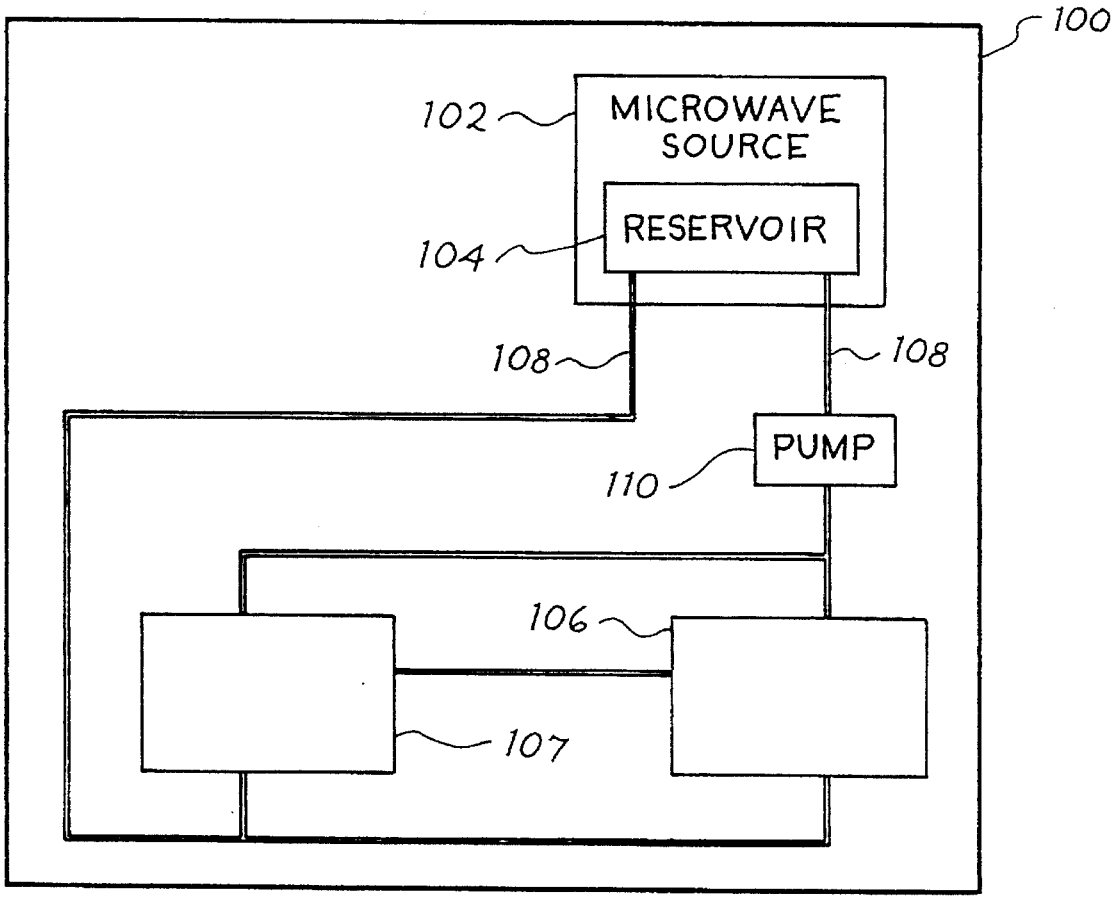
FIG. 6 is a block diagram of an embodiment of the invention directed to an apparatus for washing dishes.

Certain aspects of the invention may also be used in a dishwashing machine. A person of ordinary skill in the art may construct such a dishwashing machine by modifying a conventional dishwasher as shown in FIG. 6. More particularly, FIG. 6 represents an embodiment of a dishwashing machine 100 including a microwave source 102, a reservoir 104, a heat exchanger 106, and a dishwasher 107. The reservoir 104 is connected to the heat exchanger 106 and the dishwasher 107 through a conduit 108. A pump 110 circulates water heated by the source 102 from the reservoir 104 to the heat exchanger 106 and to the dishwasher 107. The pump 110 also circulates cooled liquid from the heat exchanger 106 and the dishwasher 107 to the reservoir 104. The dishwasher 107 uses water from the reservoir 104 heated by the source 102 to wash dishes in a known manner.

In addition, the dishwasher 107 dries dishes using air heated by the heat exchanger 106 using heated liquid from the reservoir 104. Except for the dishwasher 107 which is otherwise conventional and is known in the art, the components in this embodiment are substantially similar to corresponding components shown in FIG. 1.

Although the exemplary embodiments disclosed herein are preferred, other embodiments, modifications and changes which do not part from the spirit of the invention may become apparent to those skilled in the art. All such embodiments, modifications and changes are intended to be covered by the following claims.

What is claimed is:

1. An apparatus comprising:

a source of microwave energy having a compartment;

a reservoir, disposed in said compartment, adapted to contain a flowable medium to be heated by said source;

an inlet in communication with said reservoir;

an outlet in communication with said reservoir;

at least a portion of said inlet and said outlet being disposed outside said compartment;

an appliance, in communication with said inlet and said outlet, having a chamber for receiving articles to be washed; means for applying at least some of said flowable medium to said chamber to wash said articles; and a heat exchanger in communication with said reservoir and said appliance;

means for applying at least some of the heat from said medium to heat air; and means for passing the heated air to said articles.

2. The apparatus of claim 1 further comprising a conduit, interconnecting said reservoir and the heat exchanger, for circulating said flowable medium therebetween.

3. The apparatus of claim 2 further comprising a pump communicating with said conduit for circulating said flowable medium between said reservoir and said heat exchanger.

4. The apparatus of claim 1 further comprising a duct, coupled to said heat exchanger, for directing said heated air to a desired space.

5. The apparatus of claim 4 further comprising a blower, in communication with said duct, adapted to force at least some of the air heated by said flowable medium toward a desired space.

6. The apparatus of claim 1, wherein said articles comprise at least one dish item.

* * * * *